US009278743B2

(12) United States Patent
Bertin

(10) Patent No.: US 9,278,743 B2
(45) Date of Patent: Mar. 8, 2016

(54) MOVEMENT SYSTEM FOR SUBMARINE-ATMOSPHERIC INTERFACE DEVICES

(71) Applicant: CALZONI S.r.l., Calderara di Reno (Bologna) (IT)

(72) Inventor: Daniele Maria Bertin, Milan (IT)

(73) Assignee: CALZONI S.r.l. (IT)

( * ) Notice: Subject to any disclaimer, the term of this patent is extended or adjusted under 35 U.S.C. 154(b) by 0 days.

(21) Appl. No.: 14/428,573

(22) PCT Filed: Sep. 30, 2013

(86) PCT No.: PCT/IB2013/059002

§ 371 (c)(1),
(2) Date: Mar. 16, 2015

(87) PCT Pub. No.: WO2014/064559

PCT Pub. Date: May 1, 2014

(65) Prior Publication Data

US 2015/0274270 A1 Oct. 1, 2015

(30) Foreign Application Priority Data

Oct. 26, 2012 (IT) ..... BO2012A0587

(51) Int. Cl.
*B63G 8/38* (2006.01)

(52) U.S. Cl.
CPC ..... *B63G 8/38* (2013.01)

(58) Field of Classification Search
CPC ..... B63G 8/38
USPC ..... 114/339–340
See application file for complete search history.

(56) References Cited

U.S. PATENT DOCUMENTS

| | | | | | |
|---|---|---|---|---|---|
| 749,755 | A * | 1/1904 | Spear | G02B 23/08 | 114/340 |
| 1,290,745 | A * | 1/1919 | Hollander | B63G 8/38 | 114/340 |
| 1,298,333 | A | 3/1919 | Grebe | | |
| 1,784,500 | A * | 12/1930 | Spear | B63G 8/40 | 114/293 |
| 2,351,979 | A * | 6/1944 | Lamberti | B63G 8/41 | 114/325 |
| 2,503,748 | A * | 4/1950 | Kollmorgen | B63G 8/38 | 254/93 R |
| 2,522,280 | A | 9/1950 | Kollmorgen | | |

(Continued)

FOREIGN PATENT DOCUMENTS

| | | |
|---|---|---|
| DE | 348870 | 2/1922 |
| EP | 1739006 | 1/2007 |

(Continued)

OTHER PUBLICATIONS

International Search Report dated Feb. 20, 2014 for counterpart application No. PCT/IB2013/059002.

*Primary Examiner* — Lars A Olson
*Assistant Examiner* — Jovon Hayes
(74) *Attorney, Agent, or Firm* — Timothy J. Klima; Shuttleworth & Ingersoll, PLC

(57) ABSTRACT

A movement system for submarine-atmospheric interface devices comprises fixed guides integrally connected to a conning tower of a submarine, a lifting apparatus slidable in the fixed guides, at least one electric motor for driving the lifting apparatus and a motion transmission mechanism whereby motion is transmitted from the electric motor to the lifting apparatus and comprising flexible transmission means.

14 Claims, 6 Drawing Sheets

(56) References Cited

U.S. PATENT DOCUMENTS

| | | | | |
|---|---|---|---|---|
| 4,436,051 | A * | 3/1984 | Nollez | G02B 23/08 114/340 |
| 4,848,886 | A * | 7/1989 | Pratt | B63G 8/38 114/340 |
| 7,209,288 | B2 * | 4/2007 | Wantig | B63G 8/38 114/327 |
| 8,601,970 | B1 * | 12/2013 | Dorsky | B63G 8/04 114/244 |
| 8,960,118 | B2 * | 2/2015 | Stella | B63G 8/00 114/339 |
| 2015/0274270 | A1 * | 10/2015 | Bertin | B63G 8/38 114/339 |

FOREIGN PATENT DOCUMENTS

| | | |
|---|---|---|
| EP | 1847454 | 10/2007 |
| FR | 446558 | 12/1912 |
| GB | 146433 | 7/1921 |
| GB | 148448 | 9/1921 |
| NL | 10072 | 12/1923 |

* cited by examiner

MOVEMENT SYSTEM FOR SUBMARINE-ATMOSPHERIC INTERFACE DEVICES

This application is the National Phase of International Application PCT/IB2013/059002 filed Sep. 30, 2013 which designated the U.S.

This application claims priority to Italian Patent Application No. BO2012A000587 filed Oct. 26, 2012, which application is incorporated by reference herein.

TECHNICAL FIELD

This invention relates to a movement system for submarine-atmospheric interface devices.

BACKGROUND ART

In the submarine technical sector it is known that, when the submarine is at periscope depth, a predetermined number of passive and active sensors have to be carried out of the water, for example radar and/or radio antennae, optronic heads and the like, which are normally housed in the submarine conning tower (or sail). When necessary, these submarine-atmospheric interface devices are translated vertically by suitable lifting apparatuses, until the sensors emerge from the surface of the water above the conning tower.

It is also known that these lifting apparatuses are required to be particularly silent, to avoid being detected by acoustic sensors; resistant to underwater pressure at the depths which the submarine navigates at; resistant to corrosion by seawater; and capable of lifting the sensor lifting apparatus or mast on the mast guides, overcoming not only its own weight but also the friction generated by the hydrodynamic thrust of the water caused by submarine motion, a transversal thrust which produces most of the overall resistance to the translational movement in the vertical direction.

Other technical specifications required of the lifting apparatuses are low magnetic signature and reduced size allowing them to fit into extremely small spaces.

Some of the above requirements are met by apparatuses with oil-hydraulic drives which, however, require a hydraulic system comprising, amongst other things, a pumping station, involving constructional complications and higher maintenance requirements to protect hydraulic fluid from water infiltrations.

Traditional hydraulic drives were improved by the introduction of electric drives, which allow precision control, low maintenance and less structural complexity.

Document EP1847454, in the name of the same Applicant as this invention, describes solutions with traditional rotary electric motors which, however, need complex and noisy mechanisms which must fit into the lifting apparatus in order to protect the motor from the water and high underwater pressure. As a result, there is no significant reduction either in acoustic signature or hydrodynamic resistance.

As described in document EP1739006, in the name of the same Applicant as this invention, it is also possible to use linear electric motors, which, however, have potential properties of low density and energy efficiency and which require high electric currents and volumes.

Other solutions involve using linear motors with permanent magnets which have the disadvantage of being characterized by extended windings on the guide or by magnets mounted on the selfsame guide which expose the submarine to a magnetic signature making it easier to detect.

Furthermore, in the past other solution have been disclosed, all relating to the use of a belt (or chain) member, or similar deformable means, in a transmission system.

Some of those solutions are published, for example, in patent documents U.S. Pat. No. 1,290,745, U.S. Pat. No. 1,298,333, GB146433 and NL10072.

However, such documents only disclose a simple belt transmission having a couple of pulleys, a driving one and a driven one.

DISCLOSURE OF THE INVENTION

The technical purpose which forms the basis of this invention is to overcome the above mentioned disadvantages by providing a movement system for atmospheric submarine-interface devices which is particularly silent, resistant to corrosion, reduced in size, easy and inexpensive to make and assemble and easy to install on any submarine, requiring a limited number of operations to be performed on site.

More specifically, this invention has for an aim to provide a movement system for submarine-atmospheric interface devices which has low magnetic and acoustic signatures and which involves reduced hydrodynamic resistance of the lifting apparatus when extended.

A further aim of the invention is to provide a movement system for atmospheric interface devices in submarines which does not have watertightness problems during deep water navigation under high pressure and which requires little maintenance.

The technical purpose indicated and the aims specified are substantially achieved by a movement system for submarine-atmospheric interface devices comprising the technical features described in one or more of the appended claims.

BRIEF DESCRIPTION OF THE DRAWINGS

Further features and advantages of this invention are more apparent in the detailed description below, with reference to preferred, non-limiting embodiments of it, illustrated in the accompanying drawings, in which.

DETAILED DESCRIPTION OF THE PREFERRED EMBODIMENTS OF THE INVENTION

Figure 1:
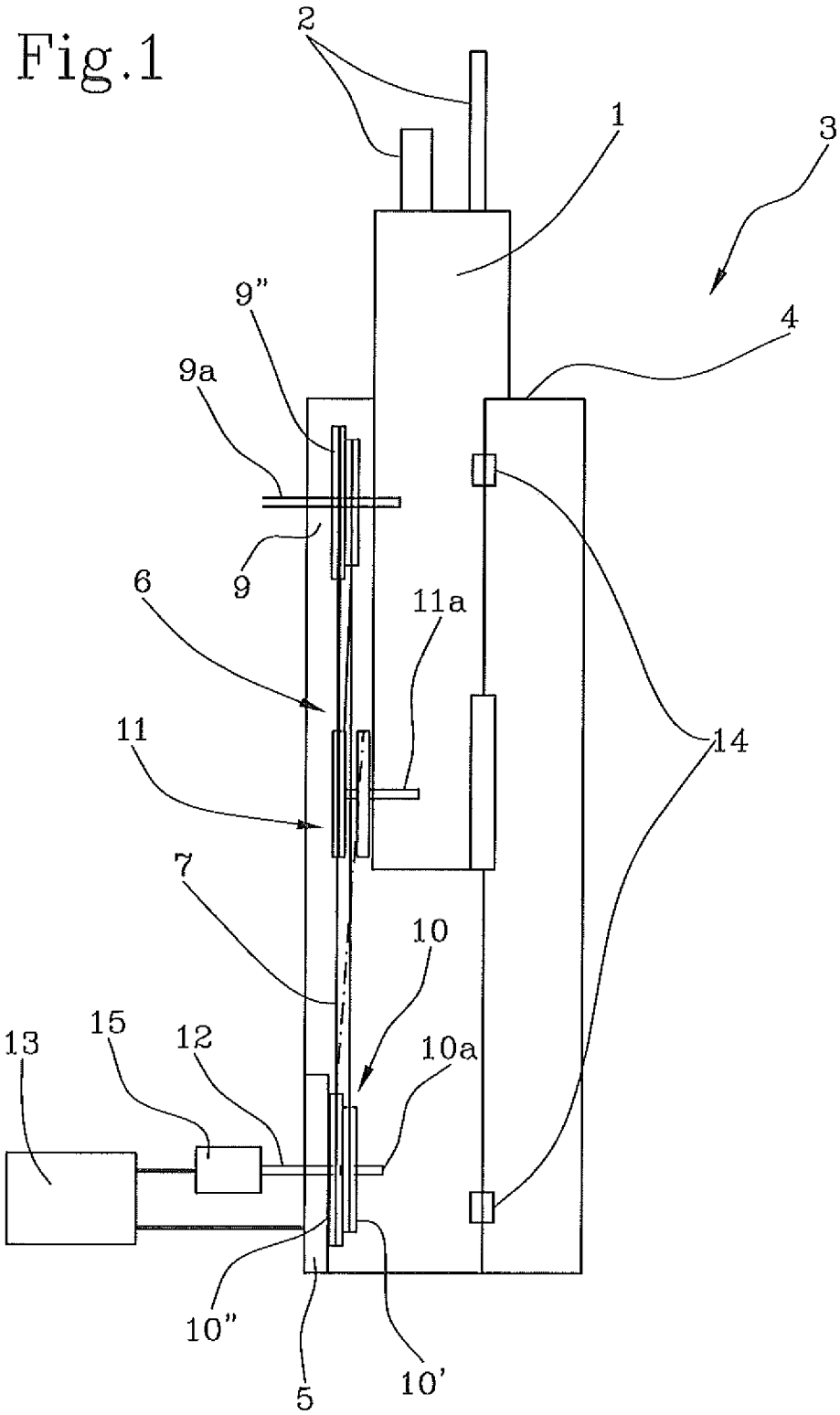
FIG. 1 is a side view of a movement system for submarine-atmospheric interface devices according to this invention.

With reference to the accompanying drawings, the numeral 1 denotes a lifting apparatus for atmospheric interface devices 2, according to this invention.

The lifting apparatus 1 is installed in a submarine 100 so that during navigation at periscope depth, the devices 2, such as sensors or antennas, can be positioned above the water surface to allow them to be used.

A movement system 3 allows the lifting apparatus 1 to carry the interface devices 2 to, and stop them at, the position where they can be correctly used.

The movement system 3 is the object of this invention.

The submarine is a watercraft capable of surface navigation and which, when necessary, can submerge for more or less extended periods of time to continue navigating underwater.

In this invention, the term "submarine" is used to mean any submersible watercraft, including naval vessels designed mainly for independent operation below the surface of the water and also able to navigate partly above surface.

In other words these naval vessels developed out of traditional "submersible" watercraft and thus fall within the scope of the invention.

The submarine 100 comprises a hull 101 extending lengthways along a respective direction of extension "A" and designed to operate underwater, below the surface "P" of the water.

The hull 101 is elongate in shape and preferably has a streamlined front portion 101*a* to improve water penetration during navigation.

The hull 101 is thus powered to navigate along a respective direction of travel both underwater and (partly) above the surface of the water.

Typically, the hull 101 is divided into two hulls (not illustrated in detail) located one inside the other and between which are defined ballast tanks which are designed to be filled or emptied (through suitable valves) to allow navigation underwater (tanks full) and at the surface (tanks empty).

The hull 101 also comprises an upper portion 102 (or back) with a conning tower 103 (or sail) rising up therefrom.

The conning tower 103 thus defines a protrusion (or projection) extending upwards from the upper portion (or back) of the hull 101 at right angles to its direction "A".

The conning tower 103 defines, inside it, a compartment 104 for housing at least one apparatus 1, according to the invention, for lifting a set of atmospheric interface devices 2 designed to measure, communicate and/or recharge the batteries of the submarine.

The compartment 104 preferably houses a plurality of lifting apparatuses 1.

Thus, the conning tower 103 houses one or more of the following interface devices 2:

the snorkel:
the periscopes;
the radio antennas;
the radar antenna;
optical visors;
sensors of diverse kinds.

In other words, the term "interface devices 2" denotes all those devices which must operate, or which preferably operate, above the water's surface, and which are generally connected to the conning tower 103.

The vertical movement of the devices 2 is thus allowed by the lifting apparatus 1 which is installed inside the conning tower 103 and which is driven by the movement system 3 described in detail below.

Substantially, the devices 2 are moved when the submarine 100 navigates at periscope depth.

The expression "navigation at periscope depth" is commonly used to mean movement of the submarine 100 in a predetermined direction of travel with the hull submerged (i.e. entirely under the surface "P") and the aforementioned devices (including the, periscope, if present) outside the water.

As illustrated in FIG. 1, the movement system 3 comprises a fixed guide 4 which is integral with the conning tower 103 of the submarine 100 and which slidably receives, in longitudinal direction, a lifting apparatus, or mast, 1 which carries the atmospheric interface devices, or sensors, 2 and which is driven by an drive 5 which, according to this invention, is an electric motor.

Obviously, the motor 5 is driven by a specific electric driver 13 configured to lift and lower the lifting apparatus 1.

It should be noted that the lifting apparatus 1 has an elongate shape, extending along a main direction (corresponding to the movement direction which, in use, is vertical).

The motor is a rotary one and is made by coupling two coaxial elements to each other, namely: a stator equipped with electric windings, and a rotor equipped with permanent magnets. The electric motor 5 is completed by a rotary shaft 12 on which the rotor turns.

The electric motor 5 is made without containment elements relative to the outside environment but in such a way as to be built into the structure of the movement system 3.

In other words, the electric motor is not inside, but outside, the lifting apparatus 1, thus reducing the size and weight of the moving structure: this is reflected in the hydrodynamic resistance encountered by the lifting apparatus 1 when it is extended at high speed, which obviously decreases, as well as in the reduction of the turbulence produced by the disturbed water.

In the preferred embodiment, the motor is based on electric motor design concepts which allow an extremely flat and compact form to be obtained.

The solutions of this kind comprise a short shaft or an axial flow electric motor.

The former, also known as radial flow motor, has a configuration based on two coaxial cylinders: the rotor turns inside the stator, which is hollow.

More specifically, the electric torque motor comprises a three-phase stator containing the electric windings, wound and impregnated, or encapsulated, in a vacuum, in a material with a high thermal conductivity, and a permanent magnet rotor, with an isotropic tubular structure which houses the magnets on its outer periphery, protected by a ring.

The axial flow electric motor, on the other hand, is a unit in which the windings and/or the magnets which attract or repel each other are mounted on two parallel discs which are close to one another and which act as stator and rotor.

The main advantages of these two types of electric motors are extremely reduced length, high efficiency and, above all, very high torque. The latter is a quality which compensates for the lower achievable RPMs compared to traditional propulsion systems, which remain more powerful with the same weight.

As to constructional design, the advantage is that of not requiring armatures or magnets with concave or convex surfaces, but only flat elements, which are more economical.

For better operation, the motors may need a position sensor (not illustrated) on the drive shaft 12 to detect field orientation and to check position and speed. The rotor is of the permanent magnet type and does not have primary winding losses and therefore, in principle, does not need cooling.

Preferably, the system also comprises one or more position sensors 14 which are located also along the guide and which provide a signal representing the position of the apparatus 1.

The embodiment described here entails using the basic components of a motor, namely, stator and rotor, and integrating them in the structure of the movement system. That way, stator, rotor and gap are minimal in size and are immersed in water or air. Another advantage of this embodiment is that it does not require seals on the rotary shaft, which would be problematical to apply on a submarine owing to the high pressures in play. Unlike motors immersed internally in a liquid (water or oil) to compensate the pressure, this motor does not require maintenance and there is no risk of liquid leakage The water present in the motor when operating underwater acts as lubricant and coolant.

The movement system 3 comprises a motion transmission mechanism 6 which connects the electric motor 5 to the lifting apparatus 1.

Preferably, the motor 5 and the motion transmission mechanism 6 are located outside a transverse dimension of the lifting apparatus 1.

It should be noted that the expression "transverse dimension" is used in this text to mean a dimension measured in a plane substantially at right angles to the direction of extension of the lifting apparatus 1.

In other words, the motor 5 and the motion transmission mechanism 6 are located outside each transverse section of the lifting apparatus.

The system also comprises a brake 15 designed to stop movement at a desired position. Preferably, the brake is an electric brake and is keyed to the shaft of the electric motor 5.

Alternatively, the brake might be located on the other shaft in order to reduce dimensions Preferably, being an electric brake, the brake 15 is controlled by the driver 13 of the motor.

More specifically, the motion transmission mechanism 6 comprises flexible transmission means 7 such as, for example, a cord, a chain, a belt, a toothed belt or the like. In the accompanying drawings, a belt is shown but without thereby restricting the scope of the invention.

Figure 2:
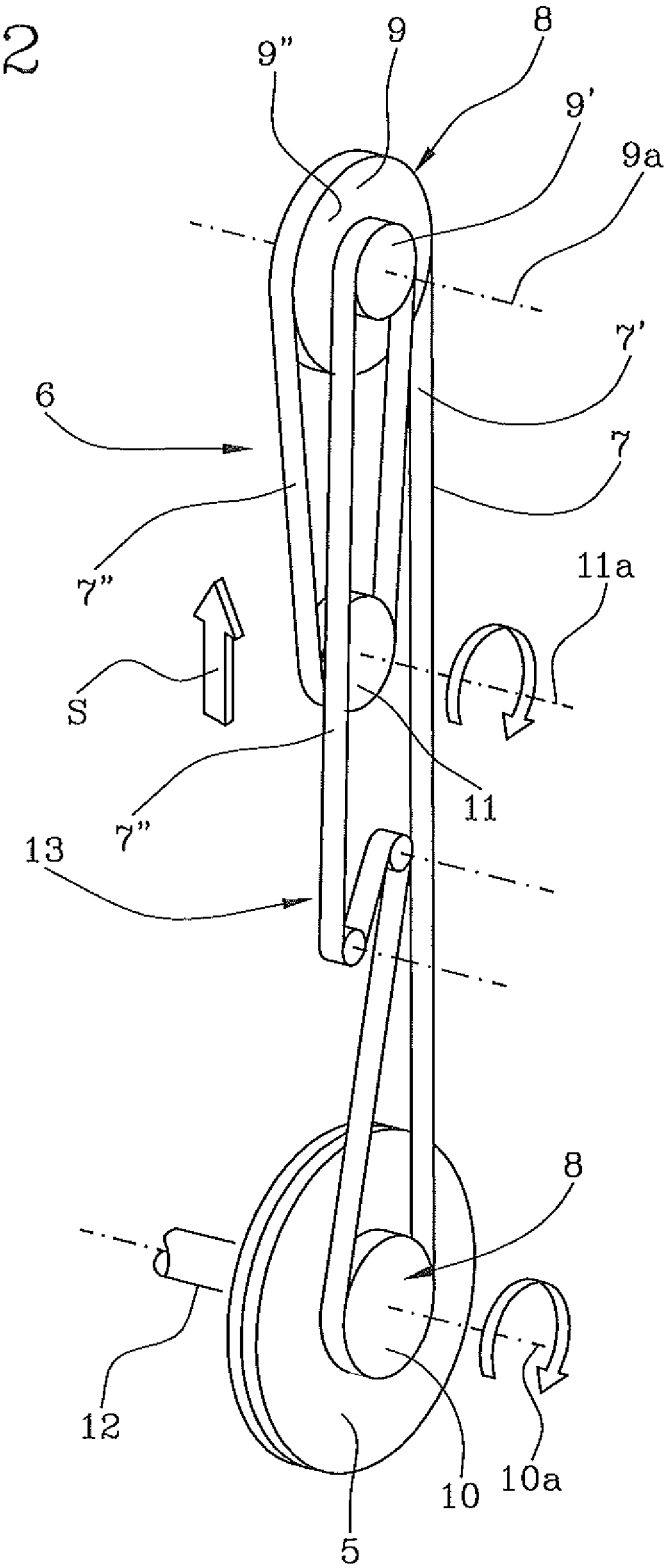
FIG. 2 is a perspective view of a portion of a first embodiment of the lifting apparatus according to the invention.
Figure 3:
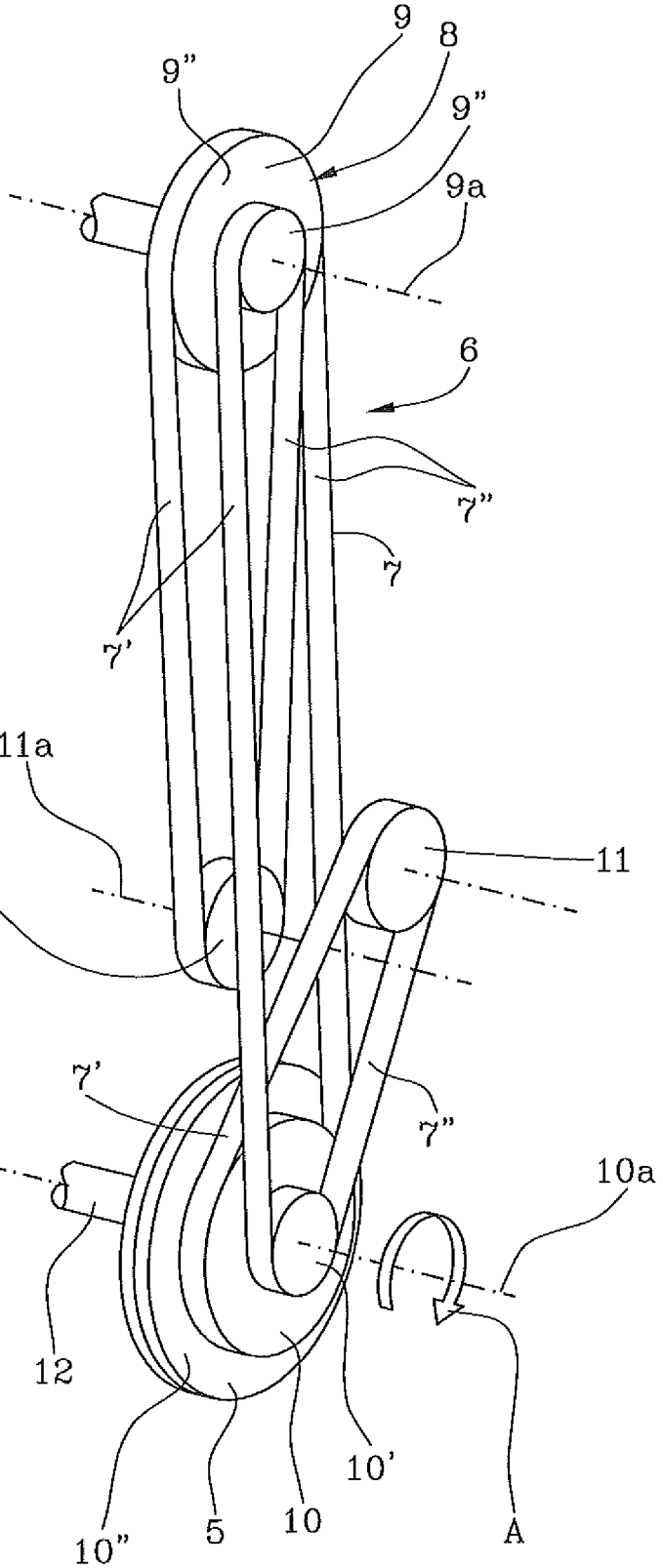
FIG. 3 is a perspective view of a portion of a second embodiment of the lifting apparatus according to the invention.
Figure 4:
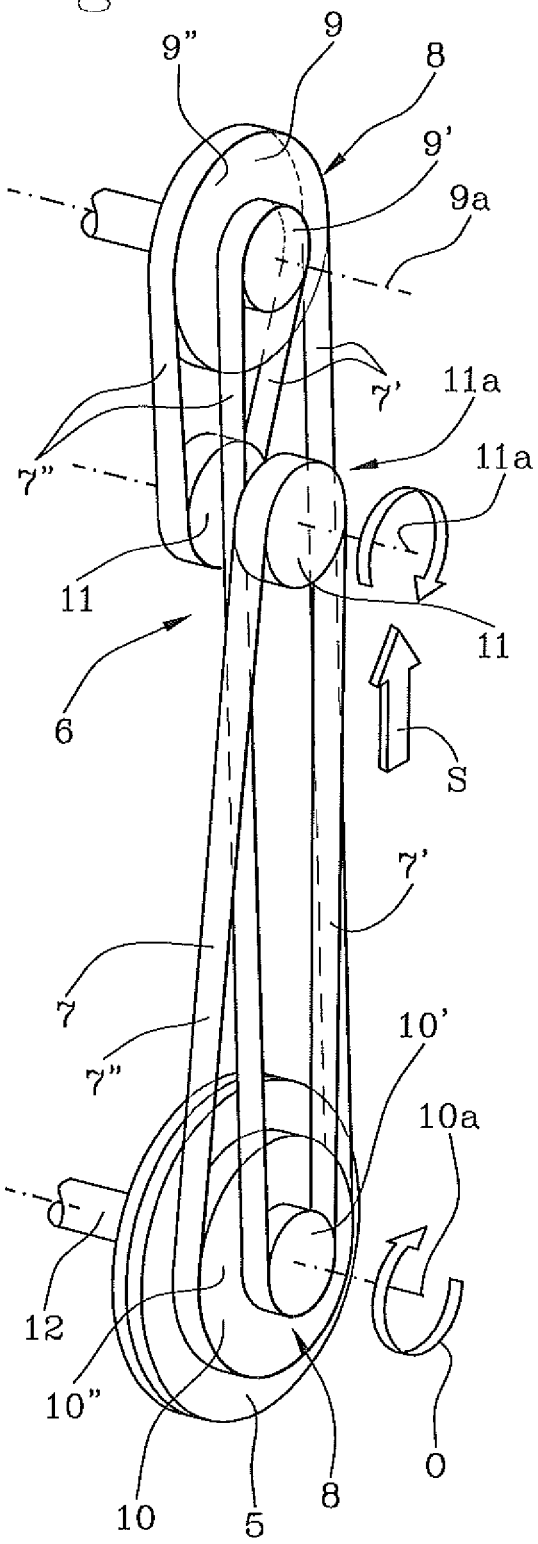
FIGS. 4 and 5 are perspective views of a portion of a second embodiment of the lifting apparatus according to the invention in a first and a second operating mode, respectively.

The motion transmission mechanism 6 also comprises a plurality of pulleys 8, around which flexible transmission means 7 are trained in such a way as to form a closed loop, as shown clearly in FIGS. 2, 3 and 4.

More specifically, the motion transmission mechanism 6 comprises at least two end pulleys 9, 10 which rotate about respective fixed axes 9*a*, 10*a* parallel to, and at a preset distance from, each other and preferably vertically aligned. The motion transmission mechanism 6 also comprises at least one central pulley 11 which is free to rotate about its own axis 11*a* and designed to be translated vertically between the end pulleys 9, 10.

The flexible transmission means 7 extend from the upper end pulley 9 to the lower end pulley 10 and are also trained around the at least one central pulley 11.

The closed loop formed by the flexible transmission means 7 is such as to cause the lifting apparatus 1 to be driven vertically at least upwards (FIG. 2).

To obtain this result, at least one of the two end pulleys 9 is double, that is to say, has at least two discs 9' and 9"which are integral with each other and differ in diameter.

Further, at least one of the two end pulleys 10 is motor-driven, through a direct connection to the electric motor 5. More specifically, the electric motor 5 and the end pulley 10 are keyed to the rotation shaft 12 of the motor.

That way, the motor-driven end pulley 10 in turn rotationally drives the flexible means 7 and sets them in motion. The movement of the flexible means 7 in one direction or the other causes the central pulley 11 to rotate clockwise or anticlockwise about its own fixed axis 11*a* and simultaneously also causes the central pulley 11 to be translated vertically upwards (FIG. 2) or downwards.

Figure 5:
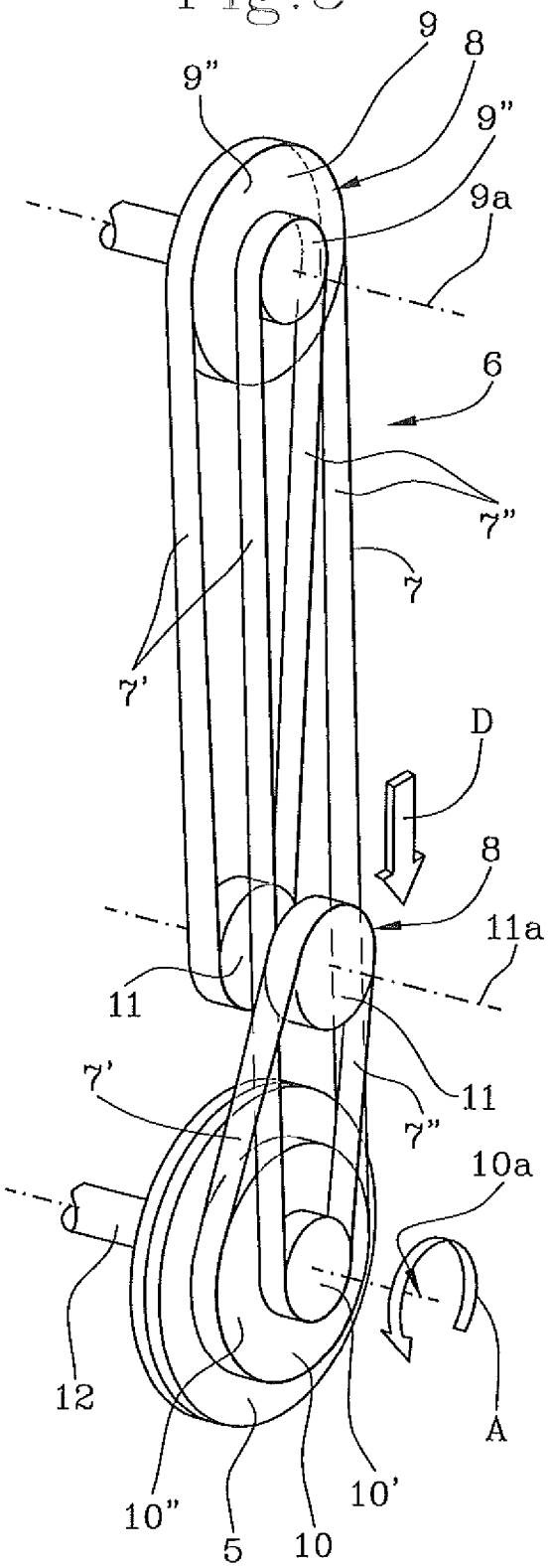

The movement system 3 of this invention has two alternative configurations, one of which (one-way operation) allows the lifting apparatus to be driven upwards only (FIG. 2) whilst the downward movement occurs by gravity, and the other of which (two-way operation) allows the lifting apparatus 1 to be driven both upwards (FIG. 4) and downwards (FIG. 5).

The electric motor 5 sets one of the two end pulleys 10 in rotation, thereby driving the flexible transmission means 7. The movement of the flexible transmission means 7 imparts the roto-translational movement to the central pulley 11 which drives the lifting apparatus 1 upwards.

The flexible transmission means 7 are trained around the pulleys 9, 10 and 11 in such a way as to allow a high reduction ratio between the rotation of the electric motor 5 and the movement of the flexible transmission means 7.

The preferred configuration is the one illustrated in FIGS. 3 and 4, where the movement system 3 is a two-way one, that is to say, it drives the lifting apparatus 1 both upwards and downwards. More specifically, FIG. 4 shows the operating step in which the motion transmission mechanism 6 allows the apparatus 1 to be lifted (as indicated by the arrow "S"), whilst FIG. 5 shows the operating step of lowering the lifting apparatus (as indicated by the arrow "D"), as described in greater detail below.

In this configuration both of the end pulleys 9, 10 are double, that is to say, each has two discs 9',9" and 10', 10" which are integral with each other, differing in diameter and rotate about a single axis 9*a* and 10*a*.

Preferably, there are two central pulleys 11, at least one of which is connected to the lifting apparatus 1, preferably at a lower portion of the lifting apparatus 1, through the axis 11*a*.

In a first embodiment, the two central pulleys 11 are coaxial and are not integral with each other but are free to rotate independently of each other about the same axis 11*a*.

The flexible transmission means 7 are trained around the pulleys 9, 10, 11 in such a way as to connect in twos one end pulley 9, 10 to a respective central pulley 11 and then the two end pulleys 9 and 10 to each other.

In the configurations illustrated, the electric motor 5 is advantageously connected to the end pulley 10 at the bottom. It makes no difference, however, if the drive pulley is the upper end pulley 9.

Depending on the drive direction of the electric motor 5, the movement system 3 moves in one direction or the other, driving the lifting apparatus 1 up or down.

More specifically, the motor-driven end pulley, that is, the one that is integral with the electric motor 5, rotates in the same direction as the motor 5, causing the relative movement of the flexible transmission means 7. The latter, being trained also around the other pulleys, cause the other pulleys to rotate clockwise or anticlockwise. As a result, the central pulleys 11, besides rotating in the same direction as the end pulleys 9 and 10, are also translated upwards or downwards.

In more detail, as shown in FIG. 4, clockwise rotation (indicated by the arrow "O") of the electric motor 5 causes the end pulley 10 associated therewith to be rotated clockwise. The latter pulls down with it the active stretches 7' of the flexible transmission means 7 on the right of the axes of rotation 9*a*, 10*a* and 11*a*, which causes the passive stretches 7" on the left of the axes of rotation 9*a*, 10*a* and 11*a* to move upwards. The other end pulley 9 and the central pulleys 11 also rotate clockwise. Further, the entire motion transmission mechanism acts on the central pulleys 11 which are translated upwards, as indicated by the arrow "S".

More precisely, in the two-way configuration, only one central pulley 11 at a time actively drives the lifting apparatus 1 vertically, while the other one is passive.

This is done also to obtain a closed loop which guarantees that the flexible transmission means 7 remain tensioned.

More specifically, during lifting (FIG. 4) the active central pulley 11 is the one connected directly to the upper end pulley 9, whilst the one connected directly to the lower end pulley 10 is passively driven.

The friction on the end pulleys 9, 10 plays a fundamental role in avoiding slippage. To maintain the right tension, it may be necessary to have two or more loops around the pulleys or to use belts with a non-slip profile.

Since the loop is closed, however, it is possible to use the tension on the passive part of the loop. In effect, the flexible transmission means 7 are generally kept at the right tension because when one of the two central pulleys 11 moves closer to the end pulley it is associated with, the other central pulley accordingly moves away from the respective end pulley.

In any case, the flexible transmission means 7 might also be kept at the right tension by a tensioning device (not illustrated).

FIG. 5 illustrates the movement in the opposite direction, causing the central pulleys, and hence the lifting apparatus 1 connected to them, to be driven downwards.

Anticlockwise rotation (indicated by the arrow "A") of the electric motor 5 causes the end pulley associated therewith to be rotated anticlockwise. In this case, the active stretches 7' of the flexible transmission means 7 are those on the left of the axes of rotation 9*a*, 10*a* and 11*a* and they move downwards. The passive stretches 7", on the other hand, are those on the right which move upwards.

The other end pulley 9 and the central pulleys 11 rotate anticlockwise and the result obtained from this movement is the downward translation of the central pulleys 11 and hence of the lifting apparatus 1 connected thereto.

In this case, the central pulley 11 which actively drives the lifting apparatus 1 downwards is the one connected directly to the lower end pulley 10 and the central pulley 11, which is connected directly to the upper end pulley 9.

In a second embodiment (FIG. 3), the two central pulleys 11, are not coaxial but have parallel, integral axes (it should be noted that it is the axes which are integral, not the central pulleys, which are always free to rotate). Advantageously, this allows the dimensions of the transmission to be reduced.

In this embodiment, the pushing force is not applied in the same axis as the vertical movement (that is, as the direction of movement of the apparatus 1).

Advantageously, however, the horizontal component (that is, at right angles to the direction of movement of the apparatus 1) of the pushing force created may be used to compensate for the pressure on the slide blocks, especially when the submarine is moving and the resistance to forward movement applies a pushing force on the apparatus 1 (that is, on the mast).

Further, generally speaking, the lifting length is so high that the angle between the cord and the vertical is very small, and becomes significant only in the proximity of the ends.

A further alternative embodiment is illustrated in FIG. 2 and entails one-way active drive movement.

In other words, the entire movement system 3 is active only to lift the lifting apparatus 1, whereas it is passive during the downward movement: in effect, the lifting apparatus 1 is returned to the non-operating position by gravity only.

With reference to FIG. 2 in particular, the movement system 3 in its one-way configuration comprises only one double end pulley 9, a motor-driven end pulley 10 and only one central pulley 11 connected to the lifting apparatus 1 through the axis of rotation 11*a*.

The flexible transmission means 7 connect the central pulley 11 to the double end pulley 9 and then the latter to the other end pulley 10, the motor-driven one.

Since there is only one central pulley 11, the tension of the flexible transmission means 7 along the closed loop is guaranteed by a tensioning or compensating mechanism 13 for the passive stretches 7" of the flexible means 7.

The movement mechanism is similar to the one described above with reference to the upward movement of the two-way configuration.

The rotation (in this case clockwise) of the electric motor 5 sets the end pulley 10 in rotation, thereby causing the active stretch 7' of the flexible means 7 to move down, in turn setting in rotation the other end pulley 9 and the central pulley 11 which is translated upwards (as indicated by the arrow "S"), thus displacing the lifting apparatus 1.

Figure 6:
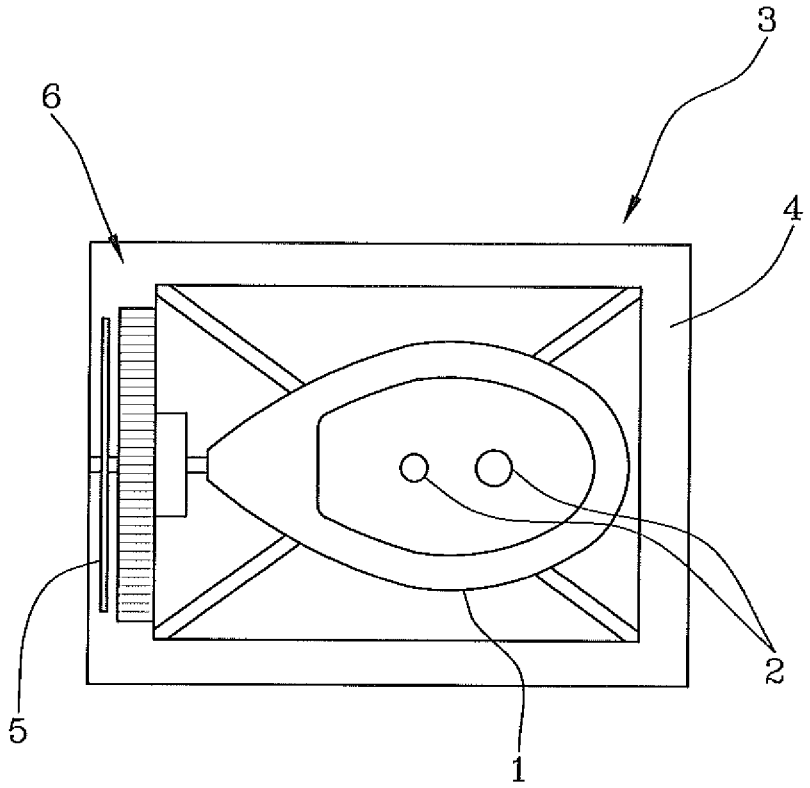
FIG. 6 shows a top view of the lifting apparatus according to the invention in a first embodiment of it.
Figure 7:
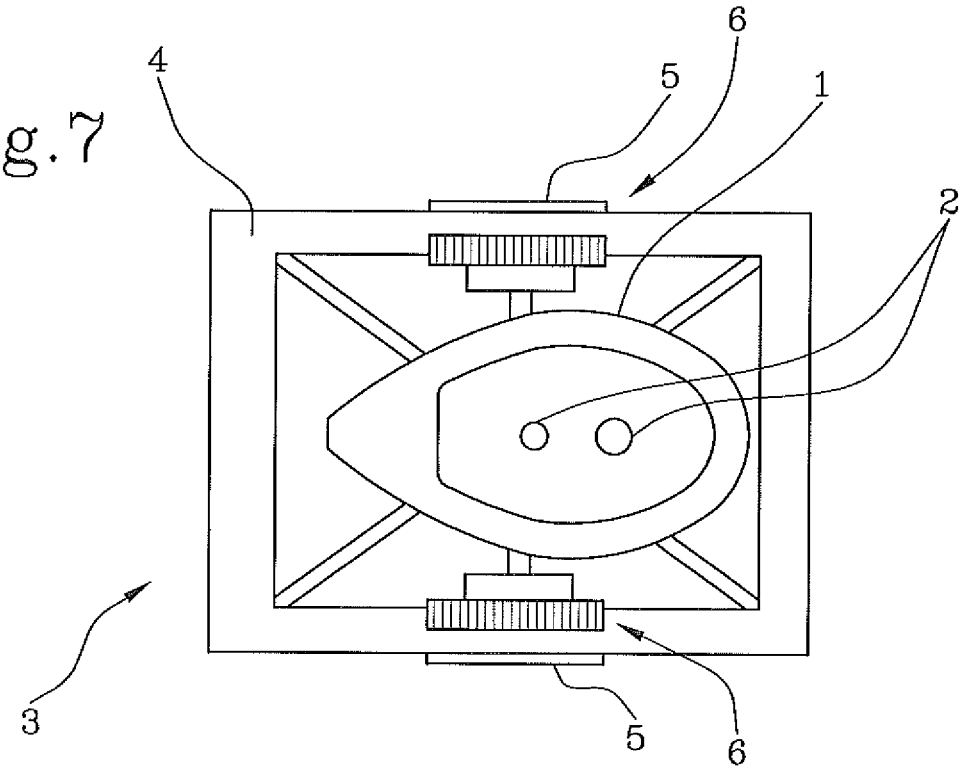
FIG. 7 shows a top view of the lifting apparatus according to the invention in a second embodiment of it.
Figure 8:
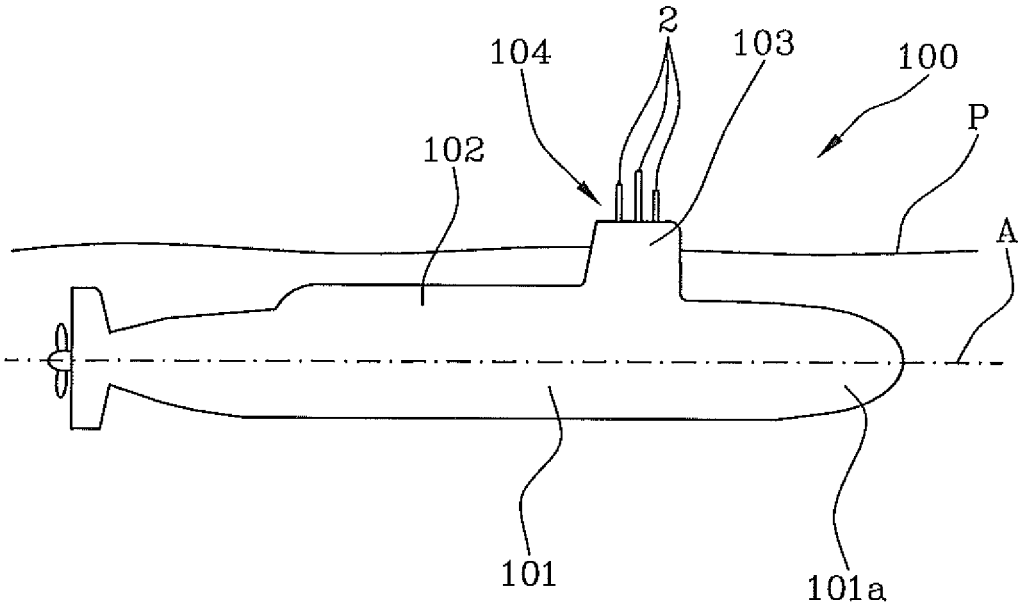
FIG. 8 schematically illustrates a submarine which mounts the lifting apparatus according to the invention.

As shown in FIGS. 6 and 7, there may be one (FIG. 6) or more (FIG. 7) movement systems 3 suitably located at the positions most appropriate for dimensional and available space requirements Advantageously, in the case of FIG. 7, the movement systems 3 are double-acting and are located on opposite sides of the guide 4, taking advantage of the free space on the sides of the guide.

Alternatively, each movement system 3 might be dedicated to the one-way movement of the lifting apparatus 1.

Advantageously, the motor 5 and the motion transmission mechanism 6 are completely outside the lifting apparatus 1. This makes it possible to reduce the volume of the part to be moved. Reducing the volume reduces the hydrodynamic resistance encountered by the lifting apparatus 1 when it is raised while the submarine is in motion.

FIGS. 6 and 7 also show a guide with a traditional sliding constraint at the four corners of the guide itself The solution also applies to guides with supports that are slidable on one side only, as for example only at the two front corners of the guide, or with a different guide architecture, provided they require a linear vertical drive movement.

It is also possible to provide the movement system 3 with lifting apparatuses 1 which are slidable in C- or double C-guides. The latter solution allows two lifting apparatuses 1 to be driven.

Also possible are mixed solutions, not illustrated, which comprise an electric motor with two or more flexible transmissions engaged on the same motor output shaft or two coaxial electric motors which drive the same flexible transmission system.

The outside diameter of the pulleys is essential to determine the transmission ratio.

The transmission ratio is fundamental to determine the pushing forces and the lifting speeds. More specifically, the lower is the transmission ratio, the lower is the displacement speed of the lifting apparatus 1.

To reduce the transmission ratio and thus adapt the speed of the motor for optimum power use, the two integral discs 9', 9" and 10', 10" of each double pulley 9 and 10 may be made similar in diameter.

The drive torque also depends on the radius of the large disc of the end pulley associated with the motor.

The drive torque can be reduced by reducing the radius of the large disc of the end pulley, compatibly with the curvature radius permissible by the flexible transmission means.

Further, the radiuses of the two end pulleys may be similar to one another, compatibly with the efficiency of the system and the friction on the pulleys themselves.

The flexible transmission means 7 can be made from metallic materials or even synthetic materials to reduce the curvature radius with high reliability and thus reduce the diameter of the pulleys for better use of motor power That way, the volumes of the motor or motors can be limited.

As may be noted, the movement system according to this invention brings important advantages.

One important advantage is doubtless that offered by the very structure of the movement system which allows it to be placed on the outside of the lifting apparatus.

The movement system is compact in size because it does not require high pressure sealed enclosures. Also, thanks to this architecture, lubricating oils and the respective containers for them are not required.

As we have seen, this makes it possible to reduce the volumes and weight of the part moved and thus to reduce the hydrodynamic resistance of the lifting apparatus when it is extended.

Reducing the volume also reduces the splashing and turbulence caused by the apparatus as it moves through the water.

A motor immersed in seawater as provided by this invention might lead one to expect disadvantages due to encrustations, leading to starting difficulties, if left idle in water for extended periods of time. In the solution provided by this invention, however, this problem is not present or has very limited effects. Indeed, during periods of inactivity, the sail of a submarine necessarily remains above the water's surface. At the same time, the lifting mechanism which this solution forms part of, is typically equipped with sliding guides whose slide blocks suffer from exactly the same problem as that of surfaces facing the thin gap between stator and rotor moving relative to each other. Thus, the problem is solved by the very fact of adopting a solution where the sliding surfaces are exposed to seawater.

When the submarine is in operation and underwater, the surfaces are cleaned during the lift/lower cycles. It is nevertheless possible to carry out special periodic maintenance to prevent encrustation.

Further, according to this invention, as already stated, the motor is exposed to water: that means it does not require maintenance for hydrostatic or hydrodynamic seals for high pressure/underwater depths.

Another sure advantage is the simplicity and reduced costs of construction and/or maintenance compared to prior art solutions.

Cooling of the electrical leads is more efficient because they are immersed directly in the fluid (air/water) surrounding the motor.

The solution proposed by the invention is also particularly silent because it does not have parts which scrape against each other or are otherwise brought into impact (gears, ball bearings or the like).

Besides, locating the electromagnetic components of the electric motor far from the water's surface allows the magnetic signature to be significantly reduced, a non-negligible advantage in a military context.

The invention claimed is:

1. A movement system for submarine-atmospheric interlace devices, comprising:

fixed guides configured to be integrally connected to a conning tower of a submarine, a lifting apparatus slidably associated with the fixed guides to be slidable therein, at least one electric motor for driving the lifting apparatus, a motion transmission mechanism whereby motion is transmitted from the electric motor to the lifting apparatus and comprising flexible transmission means and a plurality of pulleys around which the flexible transmission means are trained in such a way as to form a closed loop;

wherein the flexible transmission means extend between at least two end pulleys, which rotate about respective fixed axes parallel to, and at a preset distance from, each other, and around at least one central pulley, which rotates about an axis and which is designed to be translated between the end pulleys.

2. The system according to claim 1, wherein the central pulley is connected to the lifting apparatus in order to drive it vertically; the flexible transmission means being trained around the two end pulleys and the central pulley in such a way as to drive the lifting apparatus at least upwards.

3. The system according to claim 1, wherein at least one of the end pulleys is motor driven, through a direct connection to the electric motor.

4. The system according to claim 1, wherein at least one of the end pulleys is double and has two discs which are integral with each other and differ in diameter.

5. The system according to claim 4, wherein the end pulleys are both double, each having two discs which are integral with each other and differ in diameter.

6. The system according to claim 5, wherein it comprises two central pulleys, where at least one of these pulleys is rotatable about an axis connected to the lifting apparatus in such a way to drive it vertically.

7. The system according to claim 6, wherein the two central pulleys are coaxial with each other and free to rotate about a single axis connected to the lifting apparatus.

8. The system according to claim 6, wherein the two central pulleys are offset from each other and rotatable about parallel axes which are movable as one.

9. The system according to claim 6, wherein the flexible transmission means are trained around the two end pulleys and the two central pulleys in such a way as to drive the lifting apparatus upwards or downwards, depending on the drive direction of the electric motor.

10. The system according to claim 1, wherein the electric motor is a rotary motor and comprises a rotor and a stator which are coaxial with each other; the electric motor having a flat and compact shape.

11. The system according to claim 1, wherein the electric motor is associated with one or two motion transmission mechanisms connected to respective lifting apparatuses.

12. The system according to claim 1, wherein the electric motor is a torque motor.

13. The system according to claim 1, wherein the electric motor is an axial flow motor.

14. The system according to claim 1, wherein the motor and the motion transmission mechanism are located outside a transverse dimension of the lifting apparatus.

* * * * *